United States Patent [19]

Julemont et al.

[11] Patent Number: 5,004,556

[45] **Date of Patent: * Apr. 2, 1991**

[54] BUILT THICKENED STABLE NON-AQUEOUS CLEANING COMPOSITION AND METHOD OF USE

[75] Inventors: Michel Julemont, Heusy; Germaine Zocchi, Villers aux Tours; Nunzio Mineo, Liege; Pierre Fossny, Fays, all of Belgium

[73] Assignee: Colgate-Palmolive Company, Piscataway, N.J.

[ * ] Notice: The portion of the term of this patent subsequent to Jul. 11, 2006 has been disclaimed.

[21] Appl. No.: 341,404

[22] Filed: Apr. 21, 1989

Related U.S. Application Data

[63] Continuation of Ser. No. 63,199, Jun. 17, 1987, Pat. No. 4,846,992.

[51] Int. Cl.[5] ..... C11D 3/075; C11D 3/395; C11D 3/12

[52] U.S. Cl. ..... 252/99; 252/8.6; 252/547; 252/DIG. 14; 252/174.21

[58] Field of Search ..... 252/179.11, 179.25, 252/89.1, 8.9, 154, DIG. 14, 8.8; 8/137

[56] References Cited

U.S. PATENT DOCUMENTS

| | | | |
|---|---|---|---|
| 2,531,427 | 11/1950 | Hauser | 260/448 |
| 2,966,506 | 12/1960 | Jordan | 260/448 |
| 3,259,574 | 7/1966 | Morrison et al. | 252/28 |
| 3,549,542 | 12/1970 | Holderby | 252/137 |
| 3,557,037 | 1/1971 | Collins et al. | 260/29.1 |
| 3,594,212 | 7/1971 | Ditsch | 117/62 |
| 3,630,929 | 12/1971 | van Dijk | 252/136 |
| 3,862,058 | 1/1975 | Nirschi et al. | 252/528 |
| 3,886,075 | 5/1975 | Bernardino | 252/8.75 |
| 3,948,790 | 4/1976 | Speakman | 252/120 |
| 4,090,973 | 5/1978 | Maguire, Jr. et al. | 252/89 |
| 4,105,578 | 8/1978 | Finlayson et al. | 252/316 |
| 4,108,600 | 8/1978 | Wong | 8/137 |
| 4,208,218 | 7/1980 | Finlayson | 106/287.25 |
| 4,264,466 | 4/1981 | Carleton et al. | 252/99 |
| 4,287,086 | 9/1981 | Finlayson et al. | 252/316 |
| 4,292,035 | 9/1981 | Battrell | 8/137 |
| 4,316,812 | 2/1982 | Hancock et al. | 252/99 |
| 4,348,293 | 9/1982 | Clarke et al. | 252/90 |
| 4,397,755 | 8/1983 | Brierley et al. | 252/113 |
| 4,410,441 | 10/1983 | Davies et al. | 206/0.5 |
| 4,434,075 | 2/1984 | Mardis et al. | 252/315.2 |
| 4,434,076 | 2/1984 | Mardis et al. | 252/315.2 |
| 4,536,316 | 8/1985 | Ramachandran | 252/174.11 |
| 4,615,814 | 10/1986 | Winetzky | 252/8.6 |
| 4,615,820 | 10/1986 | Hepworth et al. | 252/129 |
| 4,622,173 | 11/1986 | Broze et al. | 252/99 |
| 4,648,983 | 3/1987 | Broze et al. | 252/135 |
| 4,661,280 | 4/1987 | Ouhadi et al. | 252/528 |
| 4,828,723 | 5/1989 | Cao et al. | 252/8.8 |

FOREIGN PATENT DOCUMENTS

| | | |
|---|---|---|
| 0040931 | 7/1986 | European Pat. Off. . |
| 2017072 | 10/1979 | United Kingdom . |
| 2141152A | 12/1984 | United Kingdom . |

OTHER PUBLICATIONS

McCutcheons Functional Materials, North American Edition, 1982, pp. 199, 208.

*Primary Examiner*—Prince E. Willis
*Assistant Examiner*—J. Silbermann
*Attorney, Agent, or Firm*—Norman Blumenkopf; Richard E. Nanfeldt; Murray M. Grill

[57] ABSTRACT

A non-aqueous liquid heavy duty laundry detergent composition comprising a suspension of builder salt in liquid nonionic surfactant in which the stability of the composition is improved by the addition of small amounts of organophilic modified clay. Stability is further enhanced by grinding the solid particulate matter, including builder salt, bleach and other minor ingredients to a particle size below about 15 microns. The preferred organophilic modified clay is a water-swellable smectite clay in which the metal cations are totally or partially exchangd with a mono- or di-long chain quaternary ammonium compound.

15 Claims, No Drawings

BUILT THICKENED STABLE NON-AQUEOUS CLEANING COMPOSITION AND METHOD OF USE

This is a continuation of application Ser. No. 07/063,199, filed June 17, 1987, now U.S. Pat. No. 4,846.992.

BACKGROUND OF THE INVENTION (1) Field of Invention

This invention relates to non-aqueous liquid fabric treating compositions. More particularly, this invention relates to thickened non-aqueous liquid laundry detergent compositions which are stable against phase separation and gelation and are easily pourable and to the use of these compositions for cleaning soiled fabrics, and dispensers therefor.

(2) Discussion of Prior Art

Liquid nonaqueous heavy duty laundry detergent compositions are well known in the art. For instance, compositions of that type may comprise a liquid nonionic surfactant in which are dispersed particles of a builder, as shown for instance in U.S. Pat. Nos. 4,316,812; 3,630,929; 4,264,466; and 4,661,280.

Liquid detergents ar often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed In some cases the product viscosity changes and it becomes either too thick to pour or so thin as to appear watery. Some clear products become cloudy and others gel on standing.

The present inventors have been extensively involved as part of an overall corporate research effort in studying the rheological behavior of nonionic liquid surfactant systems with and without particulate matter suspended therein. Of particular interest has been nonaqueous built laundry liquid detergent compositions and the problems of phase separation and settling of the suspended builder and other laundry additives. These considerations have an impact on, for example, product pourability, dispersibility and stability.

The rheological behavior of the non-aqueous built liquid laundry detergents can be analogized to the rheological behavior of paints in which the suspended builder particles correspond to the inorganic pigment and the non-ionic liquid surfactant corresponds to the non-aqueous paint vehicle.

It is known that one of the major problems with built liquid laundry detergents is their physical stability. This problem stems from the fact that the density of the solid suspended particles is higher than the density of the liquid matrix. Therefore, the particles tend to sediment according to Stoke's law. Two basic solutions exist to solve the sedimentation problem: liquid matrix viscosity and reducing solid particle size.

For instance, it is known that such suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation. U.S. Pat. No. 4,661,280 to T. Ouhadi, et al. discloses the use of aluminum stearate for increasing stability of suspensions of builder salts in liquid nonionic surfactant. The addition of small amounts of aluminum stearate increases yield stress without increasing plastic viscosity.

It has long been known that aqueous swelling colloidal clays, such as bentonite and montmorillonite clays, can be modified by exchange of the metallic cation groups with organic groups, thereby changing the hydrophilic clays to organophilic clays. The use of such organophilic clays as gel-forming clays has been described in U.S. Pat. No. 2,531,427 to E. A. Hauser. Improvements and modifications of the organophilic gel-forming clays are described, for example, in the following U.S. Pat. Nos. 2,966,506 —Jordan; 4,105,578 —Finlayson, et al.; 4,208,218 —Finlayson; 4,287,086 —Finlayson; 4,434,075 —Mardis, et al.; 4,434,076 —Mardis, et al.; all assigned to NL Industries, Inc., formerly National Lead Company. According to these NL patents, these organophilic clay gellants are useful in lubricating greases, oil based muds, oil base packer fluids, paints, paint-varnish-lacquer removers, adhesives, sealants, inks, polyester gel coats and the like. However, use as a stabilizer in a non-aqueous liquid detergent composition for laundering fabrics has not been suggested.

On the other hand, the use of clays in combination with quaternary ammonium compounds (often referred to as "QA" compounds) to impart fabric softening benefits to laundering compositions has also been described. For instance, mention can be made of the British Patent Application GB 2,141,152 A, published Dec. 12, 1984, to P. Ramachandran, and the many patents referred to therein of fabric softening compositions based on organophilic QA clays.

According to the aforementioned U.S. Pat. No. 4,264,466 to Carleton, et al., the physical stability of a dispersion of particulate material, such as detergent builders, in a non-aqueous liquid phase is improved by using as a primary suspending agent an impalpable chain structure type clay, including sepiolite, attapulgite, and palygorskite clays. The patentees state and the comparative examples in this patent show that other types of clays, such as montmorillonite clay, e.g. Bentolite L, hectorite clay (e.g. Veegum T) and kaolinite clay (e.g. Hydrite PX), even when used in conjunction with an auxiliary suspension aid, including cationic surfactants, inclusive of QA compounds, are only poor suspending agents. Carleton, et al. also refer to use of other clays as suspension aids and mention, as examples, U.S. Pat. Nos. 4,069,034; 4,005,027 (both aqueous systems);

4,166,039; 3,259,574; 3,557,037; 3,549,542 and U.K. Patent Application 2,017,072.

Grinding to reduce the particle size provides the following advantages:

1. The particle specific surface area is increased, and, therefore, particle wetting by the non-aqueous vehicle (liquid non-ionic) is proportionately improved.

2. The average distance between pigment particles is reduced with a proportionate increase in particle-to-particle interaction. Each of these effects contributes to increase the rest-gel strength and the suspension yield stress while at the same time, grinding significantly reduces plastic viscosity The above-mentioned U.S. Pat. No. 4,316,812 discloses the benefits of grinding solid particles, e.g. builder and bleach, to an average particle diameter of less than 10 microns. However, it has been found that merely grinding to such small particle sizes does not, by itself, impart sufficient long term stability against phase separation.

Therefore, still further improvements are desired in the stability of non-aqueous liquid fabric treating compositions.

Accordingly, it is an object of the invention to provide liquid fabric treating compositions which are suspensions of insoluble fabric-treating particles in a non-aqueous liquid and which are storage stable, easily pourable and dispersible in cold, warm or hot water.

Another object of this invention is to formulate highly built heavy duty non-aqueous liquid nonionic surfactant laundry detergent compositions which resist settling of the suspended solid particles or separation of the liquid phase.

Still another object of this invention is to provide a disposable single use package-dispenser for the liquid laundry detergent composition.

A specific object of this invention is to provide non-gelling, stable suspensions of heavy duty built non-aqueous liquid nonionic laundry detergent composition which includes a non-aqueous liquid composed of a nonionic surfactant, fabric-treating solid particles suspended in the non-aqueous liquid, and an amount up to about 1% by weight of an organophilic water-swellable smectite clay modified with a cationic nitrogen containing compound including at least one long chain hydrocarbon having from about 8 to about 22 carbon atoms to form an elastic network or structure throughout the suspension to increase the yield stress of the composition to thereby increase its stability, i.e. prevent settling of builder particles, etc., preferably while reducing or at least without significantly increasing, the plastic viscosity (viscosity under shear conditions) of the composition.

These and other objects of the invention which will become more apparent from the following detailed description of preferred embodiments have been accomplished based on the inventors' discovery that by adding to the non-aqueous liquid suspension a small amount of an organophilic modified clay, an elastic network structure is provided and enhances the cohesiveness of the suspension which, together with the natural tendency of the finely divided solid suspended particles to flocculate, is effective to inhibit settling of the suspended solid fabric treating particles, e.g. detergent builder, bleaching agent, antistatic agent, etc.

Accordingly, in one aspect the present invention provides a liquid heavy duty laundry composition composed of a suspension of a detergent builder salt in a liquid nonionic surfactant wherein the composition includes an amount of organophilic clay to increase the stability of the suspension.

According to another aspect, the invention provides a method for cleaning soiled fabrics by contacting the soiled fabrics with the non-aqueous liquid laundry detergent composition as described above.

According to still another aspect, the invention provides in one embodiment a single use disposable package for dispensing the thickened non-aqueous suspension and in another embodiment a doserette is used to dispense the laundry detergent composition product.

The liquid phase of the non-aqueous liquid detergent composition of this invention is comprised predominantly or totally of liquid nonionic synthetic organic detergent. A portion of the liquid phase may be composed, however, of organic solvents which may enter the composition as solvent vehicles or carriers for one or more of the solid particulate ingredients, such as in enzyme slurries, perfumes, and the like. Also, as will be described in detail below, organic solvents, such as alcohols and ethers, may be added as viscosity control and anti-gelling agents.

The nonionic synthetic organic detergents employed in the practice of the invention may be any of a wide variety of such compounds, which are well known and, for example, are described at length in the text *Surface Active Agents*, Vol II, by Schwartz, Perry and Berch, published in 1958 by Interscience Publishers, and in McCutcheon's *Detergents and Emulsifiers*, 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 22 carbon atoms and wherein the number of mols of lower alkylene oxide (of 2 or 3 carbon atoms) is from 3 to 20. Of such materials it is preferred to employ those wherein the higher alkanol is a higher fatty alcohol of 10 to 11 or 12 to 15 carbon atoms and which contain from 5 to 18, preferably 6 to 14 lower alkoxy groups per mol. The lower alkoxy is often just ethoxy but in some instances, it may be desirably mixed with propoxy, the latter, if present, often being a minor (less than 50%) proportion. Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Other useful nonionics are represented by the commercially well known class of nonionics which are the reaction product of a higher linear alcohol and a mixture of ethylene and propylene oxides, containing a mixed chain of ethylene oxide and propylene oxide, terminated by a hydroxyl group. Examples include the nonionics sold under the Plurafac trademark of BASF, such as Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide), Plurafac B26, and Plurafac RA50 (a mixture of equal parts Plurafac D25 and Plurafac RA40).

Generally, the mixed ethylene oxide-propylene oxide fatty alcohol condensation products represented by the general formula $$RO(C_3H_6O)_p(C_2H_4O)_qH,$$

wherein R is a straight or branched, primary or secondary aliphatic hydrocarbon, preferably alkyl or alkenyl, especially preferably alkyl, of from 6 to 20, preferably 10 to 18, especially to 8, preferably 3 to 6, and q is a number of from 2 to 12, preferably 4 to 10, can be advantageously used where low foaming characteristics are desired. In addition, these surfactants have the advantage of low gelling temperatures.

Another group of liquid nonionics are available from Shell Chemical Company, Inc. under the Dobanol trademark: Dobanol 91-5 is an ethoxylated $C_{9-C11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, such as 40% to 60% thereof and the nonionic detergent will often contain at least 50% of such preferred poly-lower alkoxy higher alkanol.

Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the alkoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the alkylene oxide chains are highly preferred and are considered to result in the best combination of detergency, biodegradability and non-gelling characteristics, medial or secondary joinder to the alkylene oxide in the chain may occur. It is usually in only a minor proportion of such alkyls, generally less than 20% but, as is the case of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of viscosity and gel controlling compounds can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

In view of their low gelling temperatures and low pour points, another preferred class of nonionic surfactants includes the C12–C13 secondary fatty alcohols with relatively narrow contents of ethylene oxide in the range of from about 7 to 9 moles, especially about 8 moles ethylene oxide per molecule and the C9 to C11, especially C10 fatty alcohols ethoxylated with about 6 moles ethylene oxide.

Furthermore, in the compositions of this invention, it may be advantageous to include an organic solvent or diluent which can function as a viscosity control and gel-inhibiting agent for the liquid nonionic surface active agents. Lower ($C_1$–$C_6$) aliphatic alcohols and glycols, such as ethanol, isopropanol, ethylene glycol, hexylene glycol and the like have been used for this purpose. Polyethylene glycols, such as PEG 400, are also useful diluents. Alkylene glycol ethers, such as the compounds sold under the trademarks, Carbopol and Carbitol which have relatively short hydrocarbon chain lengths (C2–C8) and a low content of ethylene oxide (about 2 to 6 EO units per molecule) are especially useful viscosity control and anti-gelling solvents in the compositions of this invention. This use of the alkylene glycol ethers is disclosed in the commonly assigned copending application Ser. No. 687,815, filed Dec. 31, 1984, to T. Ouhadi, et al. Suitable glycol ethers can be represented by the following general formula $$RO(CH_2CH_2O)_nH$$

where R is a $C_2$–$C_8$, preferably $C_2$–$C_5$, alkyl group, and n is a number of from about 1 to 6, preferably 1 to 4, on average.

Specific examples of suitable solvents include ethylene glycol monoethyl ether ($C_2H_5$—O—$CH_2CH_2OH$), diethylene glycol monobutyl ether ($C_4H_9$—O—($CH_2C$-

$H_2O)_2H$), tetraethylene glycol monooctyl ether ($C_8H_{17}$—O—($CH_2CH_2O)_4H$), etc. Diethylene glycol monobutyl ether is especially preferred.

The amount of the nonionic surfactant is generally within the range of from about 20% to about 70%, such as about 30% to 60% for example 35% or 40% by weight of the composition. The amount of solvent or diluent when present is usually up to 20%, preferably up to 15%, for example, 0.5% to 15%, preferably 5.0% to 12%. The weight ratio of nonionic surfactant to alkylene glycol ether as the viscosity control and anti-gelling agent, when the latter is present, as in the preferred embodiment of the invention is in the range of from about 100:1 to 1:1, preferably from about 50:1 to about 2:1, such as 10:1, 8:1, 6:1 or 4:1.

The invention detergent compositions also include as an essential ingredient water soluble and/or water dispersible detergent builder salts. Typical suitable builders include, for example, those disclosed in the aforementioned U.S. Pat. Nos. 4,316,812, 4,264,466, 3,630,929, and many others. Water-soluble inorganic alkaline builder salts which can be used alone with the detergent compound or in admixture with other builders are alkali metal carbonate, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate, sodium tripolyphosphate (TPP) is especially preferred where phosphate containing ingredient are not prohibited due to environmental concerns. The alkali metal silicates are useful builder salts which also function to make the composition anticorrosive to washing machine parts. Sodium silicates of $Na_2O/SiO_2$ ratios of from 1.6/1 to 1/3.2, especially about ½ to ⅓.8 are preferred. Potassium silicates of the same ratios can also be used.

Another class of builders highly useful herein are the water-insoluble aluminosilicates, both of the crystalline and amorphous type. Various crystalline zeolites (i.e. alumino-silicates) are described in British Patent 1,504,168, U.S. Pat. No. 4,409,136 and Canadian Patents 1,072,835 and 1,087,477, all of which are hereby incorporated by reference for such descriptions. An example of amorphous zeolites useful herein can be found in Belgium Patent 835,351 and this patent too is incorporated herein by reference. The zeolites generally have the formula $$(M_2O)_x(Al_2O_3)_y(SiO_2)_zWH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/0 g.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2-hydroxyethyl)nitrilodiacetates. Mixed salts of these polycarboxylates are also suitable.

Other suitable builders of the organic type include carboxymethylsuccinates, tartronates and glycollates and the polyacetal carboxylates. The polyacetal carboxylates and their use in detergent compositions are described in U.S. Pat. Nos. 4,144,226; 4,315,092 and 4,146,495. Other patents on similar builders include 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0015024, 0021491 and 0063399.

The proportion of the suspended detergent builder, based on the total composition, is usually in the range of from about 10 to 60 weight percent, such as about 20 to 50 weight percent, for example about 25% to 40% by weight of the composition.

According to this invention the physical stability of the suspension of the detergent builder compound or compounds and any other suspended additive, such as bleaching agent, etc., in the liquid vehicle is drastically improved by the presence of a stabilizing agent which, according to this invention, is an elastic network forming organophilic modified clay.

The organophilic modified clay can be based on any swelling clay modified to exhibit high gelling efficiency in the organic liquid vehicle. As examples of such swelling clay materials which can be used (after appropriate modification as described below) mention can be made of the smectite clays especially the bentonites, e.g. sodium and lithium bentonites; montmorillonites, e.g. sodium and calcium montmorillonites; saponites, e.g. sodium saponites; and hectorites, e.g. sodium hectorites Other representative clays include beidellite and stevensite.

The aforementioned smectite-type clays are three-layer clays characterized by the ability of the layered structure to increase its volume several-fold by swelling or expanding when in the presence of water to form a thixotropic gelatinous substance. There are two main classes of smectite-type clays: in the first class, aluminum oxide is present in the silicate crystal lattice; in the second class, magnesium oxide is present in the silicate crystal lattice. Atom substitution by iron, magnesium, sodium, potassium, calcium and the like can occur within the crystal lattice of the smectite clays. It is customary to distinguish between clays on the basis of their predominant cation. For example, a sodium clay is one in which the cation is predominantly sodium. Aluminum silicates wherein sodium is the predominant cation are preferred, such as, for example, bentonite clays. Among the bentonite clays, those from Wyoming (generally referred to as western or Wyoming bentonite) are especially preferred.

Preferred swelling bentonites are sold under the trademark Mineral Colloid, as industrial bentonites, by Benton Clay Company, an affiliate of Georgia Kaolin Co. These materials which are the same as those formerly sold under the trademark THIXO-JEL, are selectively mined and beneficiated bentonites, and those considered to be most useful are available as Mineral Colloid No's. 101, etc. corresponding to THIXO-JELs No's 1, 2, 3 and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferably, the bentonite is one wherein essentially all the particles (i.e, at least 90% thereof, preferably over 95%) pass through a No. 325 sieve and most preferably all the particles pass through such a sieve. The swelling capacity of the bentonites in water is usually in the range of 2 to 15 ml/gram, and its viscosity, at a 6% concentration in water, is usually from about 8 to 30 centipoises.

Instead of utilizing the THIXO-JEL or Mineral Colloid bentonites one may employ products, such as that sold by American Colloid Company, Industrial Division, as General Purpose Bentonite Powder, 325 mesh, which has a minimum of 95% thereof finer than 325 mesh or 44 microns in diameter (wet Particle size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis on an "anhydrous" basis, is 63.0% silica, 21.5% alumina, 3.3% of ferric iron (as$Fe_2O_3$), 0.4% of ferrous iron (as FeO), 2.7% of magnesium (as MgO), 2.6% of sodium and potassium (as $Na_2O$). 0.7% of calcium (as CaO), 5.6% of crystal water (as $H_2O$) and 0.7% of trace elements.

Although the western bentonites are preferred it is also possible to utilize other bentonites, such as those which may be made by treating Italian or similar bentonites containing relatively small proportions of exchangeable monovalent metals (sodium and potassium) with alkaline materials, such as sodium carbonate, to increase the cation exchange capacities of such products. It is considered that the $Na_2O$ content of the bentonite should be at least about 0.5%, preferably at least 1% and more preferably at least 2% so that the clay will be satisfactory swelling. Preferred swelling bentonites of the types described above are sold under the trade names Laviosa and Winkelmann, e.g. Laviosa AGB and Winkelmann G-13. Other examples include Veegum F and Laponite SP, both sodium hectorites, Gelwhite L, a calcium montmorillonite, Gelwhite GP, a sodium montmorillonite, Barasym LIH 200, a lithium hectorite.

The smectite clay materials as described above are hydrophilic in nature. i.e. they display swelling characteristics in aqueous media. Conversely, they are organophobic in nature and do not swell in nonaqueous or predominantly non-aqueous systems.

According to this invention, the organophobic nature of the smectite clay materials is converted to an organophilic nature. This can be accomplished be exchanging the metal cation, e.g. Na, K, Li, Ca, etc. of the clay, with an organic cation, at least on the surface of the clay particles. This can be accomplished, for example, by admixing the clay, organic cation and water, together, preferably at a temperature within the range of 20° C. to 100°C., for a period of time sufficient for the organic cation to intercalate with the clay particles at least on the surface, followed by filtering, washing, drying and grinding. For further details reference can be made to any of the aforementioned U.S. Pat. Nos. 2,531,427, 2,966,506, 4,105,578, 4,208,218, 4,287,086, 4,424,075 and 4,434,076 the disclosures of which are incorporated herein in their entireties by reference thereto.

The organic cationic material is preferably a quaternary ammonium compound, particularly one having surfactant properties, indicative of at least one long chain hydrocarbon group (e.g. from about 8 to about 22 carbon atoms), although surfactant properties or other fabric beneficial properties are not required, nor is it essential that the cationic modifier itself be useful as a suspension agent. However, any of the cationic surfactant the aforementioned U.S. Pat. Nos. 4,264,466, at columns 23–29, the disclosure of which is incorporated herein in its entirety, can be used for modifying the smectite clay material to render the latter organophilic. The organic cationic nitrogen compounds described in the aforementioned U.S. pat. No. 2,531,427 to Hauser, or those mentioned in any of the NL Industries, U.S. pat. Nos. 2,966,506; 4,105,578, and so on, the disclosures of which are incorporated herein by reference, can also be favorably used.

The preferred modifiers are the quaternary ammonium compounds of formula $$[R_1R_2R_3R_4N]^+X^-$$

wherein $R_1$, $R_2$, $R_3$ and $R_4$, are each, independently, hydrogen, or a hydrophobic organic alkyl, aryl, aralkyl, alkaryl or alkenyl radical containing from 1 to 30 carbon atoms, preferably 1 to 22 carbon atoms, at least two R groups prefer from 1 to 6 carbon atoms and at least one R group, preferably at most two R groups, having from 8 to 22 carbon atoms; and X is an anion, which may be inorganic, such as, halide, e.g. chloride or bromide, sulfate, phosphate, hydroxide, or nitrate, or organic, such as, methylsulfate, ethylsulfate, or fatty acid, e.g. acetate, propionate, laurate, myristate, palmitate, oleate or stearate.

Examples of preferred organophilic modifiers are the mono- and di-long chain (e.g. $C_2$ to $C_{18}$, especially $C_{10}$ to $C_{18}$) alkyl quaternary compounds. Representative examples of the mono-long chain quaternary ammonium surfactants include stearyl trimethyl ammonium chloride, tallow trimethyl ammonium chloride, benzyl stearyl dimethyl ammonium chloride, benzyl hydrogenated tallow dimethyl ammonium chloride, benzyl cetyl dimethyl ammonium chloride and the corresponding bromides, iodides, sulfates, methosulates, acetates, and other anions previously mentioned. Typical representative examples of the di-long chain quaternary ammonium compounds include dimethyl distearyl ammonium chloride, dimethyl dicetyl ammonium chloride, ammonium chloride, dimethyl myristyl cetyl ammonium chloride, and the corresponding bromides, iodides, sulfates, methosulfates, acetates and other anions previously mentioned. Other representative compounds include octadecyl ammonium chloride, hexadecyl ammonium acatete, and so on.

In addition to the quaternary ammonium (QA) compounds, other quaternizable nitrogen containing organic cations can also be used to form organophilic clay particles. For instance mention can be made of imidazolinium compounds such as, for example, 1-(2-hydroxyethyl)—2—dodecyl—1—benzyl-2imidazolinium chloride, and heterocyclic nitrogen ring containing compounds, such as long chain hydrocarbon substituted pyrrolidones, pyridenes, morpholines, and the like, such as N,N-octadecylmorpholinium chloride.

The amount of organic cation substitution need only be that amount sufficient to impart to the clay the requisite organophilic property to provide the enhanced stabilizing characteristic desired. Generally, depending on the nature of the organic substituent this amount can range from about 10% to 100%, preferably 20% to 100%, such as 30%, 40%, 50% or 60%, of the available base exchange capacity of the clay material. Usually, and preferably, at least sufficient of the organic compound is used to cover or coat the surface of the clay particles.

Suitable organophilic clays which can be used in this invention are commercially available, for example, the products sold under the Bentone trademark of NL Industries, New York, N.Y., such as Bentone 27, which is a hectorite clay (magnesium montmorrilonite) modified with benzyl dimethyl hydrogenated tallow ammonium chloride, and Bentone 38, which is a hectorite clay, modified with dimethyl dioctadecyl ammonium chloride. Other sources of organophilic clays include, for example, Sud-Chemie, Munich Germany; Laviosa, Livorno, Italy; Laporte, France; and Perchem, United Kingdom.

The organophilic clays are used in only minor amount, generally less than 1.0% by weight, preferably less than 0.7% by weight, based on the total composition. Usually, amounts of at least about 0.1 weight percent, preferably 0.2 weight percent, such as 0.25%, 0.3%, 0.35% or 0.4%, will enable production of stable, thixotropic non-aqueous liquid suspensions of finely divided detergent builder or other water soluble or dispersible fabric treating agent.

The organophilic modified clay can be incorporated into the non-aqueous liquid dispersion of the suspended particulate ingredients either directly as a powder or after first being predispersed in a portion of the liquid vehicle of the suspension, e.g. the liquid nonionic surfactant, the latter method being preferred. Furthermore, whether added to the suspension directly as a powder or pregelled in a portion of the liquid vehicle, the organophilic clay may be added to the suspension before or after the suspension is ground to the required average particle size of no more than 15 microns, preferably no more than 10, especially from 1 to 10 microns, most preferably from 4 to 8 microns.

In a preferred embodiment the organophilic clay is first predispersed either in part of the liquid nonionic surfactant forming the principal liquid vehicle or in a different described, surfactant or in a solvent or diluent as previously described, or in any suitable mixture of surfactant(s), and/or solvent(s), and/or diluent(s). The predispersed clay suspension, if necessary, can be subjected to grinding in a high shear grinder, to form an organophilic clay pregel. Separately, the remaining solid particulate matter is suspended in the liquid nonionic surfactant and optional diluent/solvent, and is also subjected to grinding. The clay pregel and the particulate matter suspension can be ground to the final desired average particle size before they are mixed with each other, or the pregel and suspension can be mixed and then subjected to further grinding. In the latter case, the suspended particulate matter can further contribute to the attrition of the organophilic clay particles.

Since the compositions of this invention are generally highly concentrated, and, therefore, may be used at relatively low dosages, it is often desirable to supplement any phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof. The amount of the auxiliary builder is generally up to about 6 weight percent, preferably ¼ to 4%, such as 1%, 2% or 3%, based on the total weight of the composition. Of course, the present compositions, where required by environmental constraints, can be prepared without any phosphate builder. In addition to the detergent builders, various other detergent additives or adjuvants may be present in the detergent product to give it additional desired properties, either of functional or aesthetic nature. Thus, there may be included in the formulation, minor amounts of soil suspending or antiredeposition agents, e.g. polyvinyl alcohol, fatty amides, sodium carboxymethyl cellulose, hydroxy-propyl methyl cellulose, usually in amounts up to 10 weight percent, for example 0.1 to 10%, preferably 1 to 5%; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations. Typically, amount of the optical brightener up to about 2 weight percent, preferably up to 1 weight percent, such as 0.1 to 0.8 weight percent, can be used.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of C12 to C22 alkyl alcohol with C12 to C18 alkylsulfate; 1 pH modifiers and pH buffers; color safe bleaches, perfume, and anti-foam agents or suds-suppressors, e.g. silicon compounds can also be used.

The bleaching agents are classified broadly for convenience, as chlorine bleaches and oxygen bleaches. Chlorine bleaches are typified by sodium hypochlorite (NaOC1), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu^{2+}$ ions, such that the stability constant (pK) of the complexation is equal to or greater than 6, at 25° C, in water, of an ionic strength of 0.1 mole/liter, pk being conventionally defined by the formula: pK= −log K where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above, the compounds sold under the Dequest trademark, such as, for example, diethylene triamine pentaacetic acid (DETPA); diethylene triamine pentamethylene phosphonic acid (DTPMP); and ethylene diamine tetramethylene phosphonic acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

The composition may also contain an inorganic insoluble thickening agent or dispersant of very high surface area such as finely divided silica of extremely fine particle size (e.g. of 5–100 millimicrons diameters such as sold under the name (Aerosil) or the other highly voluminous inorganic carrier materials disclosed in U.S. Pat. No. 3,630,929. It is preferable, however, that compositions which form peroxyacids in the wash activator therefor) be substantially free of such compounds and of other silicates; it has been found, for instance, that silica and silicates promote the undesired decomposition of the peroxyacid.

Although not required to achieve acceptable product stability, it is also within the scope of this invention to include other suspension stabilizers, rheological additives, and antigelling agents. For example, the aluminum salts of higher fatty acids, especially aluminum stearate, as disclosed in U.S. Pat. No. 4,661,280, the disclosure of which is incorporated herein by reference, can be added to the composition, for example, in amount of 0% to 3% by weight, preferably 0% to 1% by weight.

Another potentially useful stabilizer for use in conjunction with the organophilic clay, is an acidic organic phosphorus compound having an acidic-POH group, as disclosed in the commonly assigned copending application Ser. No. 781,189, filed Sept. 25, 1985, to Broze, et al., now U.S. Pat. No. 4,749,512 the disclosure of which is incorporated herein by reference thereto. The acidic organic phosphorus compound, may be, for instance, a partial ester of phosphoric acid and an alcohol, such as an alkanol having a lipophilic character, having, for instance, more than 5 carbon atoms, e.g. 8 to 20 carbon atoms. A specific example is a partial ester of phosphoric acid and a C16 to C18 alkanol. Empiphos 5632 from Marchon is made up of about 35% monoester and 65% diester. When used amounts of the phosphoric acid compound up to about 3%, preferably up to 1%, are sufficient.

As disclosed in copending application Serial No. 926,851, filed Nov. 3, 1986, to Broze, et al., the disclosure of which is incorporated herein by reference, a nonionic surfactant which has been modified to convert a free hydroxyl group to a moiety having a free carboxyl group, such as a partial ester of a nonionic surfactant and a polycarboxylic acid, can be incorporated into the composition to further improve rheological properties. For instance, amounts of the acid-terminated nonionic surfactant of up to 1 part per part of the nonionic surfactant are sufficient.

Suitable ranges of these optional detergent additives are: are: enzymes—0% to 2%, especially 0.1 to 1.3%; corrosion inhibitors—about 0% to 40%, and preferably 5% to 30%; anti-foam agents and suds-suppressors—0% to 15%, preferably 0% to 5%, for example 0.1% to 3%; thickening agent and dispersants—0% to 15%, for example 0.1% to 10%, preferably 1% to 5%, soil suspending or anti-redeposition agents and anti-yellowing agents—0% to 10%, preferably 0.5% to 5%; colorants, perfumes, brighteners and bluing agents total weight 0% to about 2% and preferably 0% to about 1%; pH modifiers and pH buffers—0% to 5%, preferably 0% to 2%; bleaching agent—0% to about 40% and preferably 0% to about 25%, for example 2% to bleach stabilizers and bleach activators 0% to about 15%, preferably 0% to 10%, for example, 0.1% to 8%; enzyme-inhibitors 0 to 15%, for example, 0.01% to 15%, preferably 0.1% to 10%; sequestering agent of high complexing power, in the range of up to about 5%, preferably ¼ to 3%, such as about ½ to 2%. In the selections of the adjuvants, they will be chosen to be compatible with the main constituents of the detergent composition.

In a preferred form of the invention, the mixture of liquid nonionic surfactant and solid ingredients is subjected to grinding, for example, by a sand mill or ball mill. Especially useful are the attrition types of mill, such as those sold by Wiener-Amsterdam or Netzsch-Germany, for example, in which the particle sizes of the solid ingredients are reduced to less than about 15 microns, e.g. to an average particle size of 2 to 10 microns or even lower (e.g. 1 micron). Preferably less than about 10%, especially less than about 5% of all the suspended particles have particle sizes greater than 15 microns, preferably 10 microns. Since the hygroscopicity of the ground clay generally increases as particles size decreases it is often preferred that the average particle size be at least about 3 microns, especially about 4 microns. Compositions whose dispersed particles are of such small size have improved stability against separation or settling on storage. Other types of grinding mills, such as toothmill, peg mill and the like, may also be used.

In the grinding operation, it is preferred that the proportion of solid ingredients be high enough (e.g. at least about 40%, such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g., to about 40 microns) prior to the step of grinding to an average particle diameter below about 10 microns in the continuous ball mill.

Alternatively, the powdery solid particles may be finely ground to the desired size before blending with the liquid matrix, for instance, in a jet-mill.

The compositions of this invention are gel-like liquid suspensions, generally exhibiting non-Newtonian flow characteristics, especially thixotrophy, namely reduced viscosity under applied stress or shear, and behave, rheologically, substantially according to the Casson equation. The compositions are characterized by a yield stress between about 2.5 and 45 pascals, more usually between 10 and 35 pascals, such as 15, 20 or 25 pascals. Furthermore, the compositions have plastic viscosities ranging from about 50 to about 500 m Pa·sec (50 to 500 centipoise), usually from about 80 to 300 m Pa·sec, such as 160, 200 or 240 m Pa·sec. However, when shaken or subjected to stress, such as being squeezed through a narrow opening in a squeeze tube bottle, for example, the product is readily flowable. Thus, the compositions of this invention may conveniently be packaged in ordinary vessels, such as glass or plastic, rigid or flexible bottles, jars or other containers, and dispensed therefrom.directly into the aqueous wash bath, such as in an automatic washing machine, in usual amounts, such as ¼ to 1½ cups, for example, ½ cup, per laundry load (of approximately 3 to 15 pounds, for example), for each load of laundry, usually in 8 to 18 gallons of water. The compositions will remain stable (no more than 1 or 2 mm liquid phase separation) when left to stand for periods of 3 months or longer.

In one embodiment of the invention, rather than pouring the thickened composition directly into the aqueous wash bath, the composition is first transferred into a perforated dispenser (referred to as a "doserette"), such as a plastic (water insoluble) ball, having an inner volume preferably just sufficient to hold up to 1½ cups, or other appropriate amount corresponding to the maximum recommended dosage for a large load of laundry. For this purpose the ball is provided with a closable fill opening through which the composition can be poured and then closed, for example, a screw cap, friction cap or the like. The perforations will be sufficiently small, for example, 1/64-inch to ⅛-inch, preferably 1/64 to 1/16 inch, in diameter, 1 to prevent the thickened composition from freely flowing out of the perforations in the doserette. However, the perforations are sufficiently large to allow the water of the aqueous wash bath to freely flow into the doserette and to sufficiently dilute the thickened suspension so as to allow the composition to be washed out of the doserette into the aqueous wash bath over the first several minutes of the wash cycle, for example, in about 1 to 3 minutes. In this way, the consumer can readily fill the doserette to the appropriate level for the amount and type of laundry being washed and place the filled doserette (after sealing the fill opening) directly into the washing machine with the load of laundry. Preferably, the doserette is formed of sufficiently strong plastic, such as polystyrene, polyethylene, polypropylene, polyvinyl chloride, etc. to be able to withstand repeated usage.

Alternatively, it may be more convenient in certain cases to pre-package the thickened suspensions in premeasured dosage forms for single use in discardable packets or sachets. For instance, it is known to package various laundry products in pouches formed from water soluble materials, such as polyvinyl alcohol, i.e. hydrolyzed polyvinyl acetate, for example, a degree of hydrolysis of at least 60%, such as 80% to 100%, e.g. 85%.

In a preferred embodiment of the invention, a two component disposable sachet dispenser is used. According to this embodiment, the sachet dispenser includes an outer pouch or bag of a water permeable or porous water insoluble film or fabric and an inner pouch or bag of a water soluble film, such as the polyvinyl alcohol mentioned above. The inner bag is filled to the appropriate unit dosage with the thickened fabric treating suspension and is then sealed. The inner packet is then sealed within the outer packet and may be free floating therein, i.e. not attached to the walls of the outer bag, or it may be sealed to one or more edges or walls thereof by any suitable means, such as adhesives, heat sealing, staples, sewing, etc. In use in the aqueous wash bath the water from the bath permeates or flows through the outer bag and contacts the inner bag which then dissolves upon exposure to the water and exposes the thickened suspension to the wash water inside the pouch and allows the fabric treating 1 detergent, detergent builder, and so on, to permeate out of the outer bag to the aqueous wash bath. In this way, the invention composition can be gradually introduced into the wash bath during the wash cycle, preferably over the course of one or more minutes, for example, from 1 to 5 minutes. Although the non-water soluble outer bag can be fabricated from a perforated water insoluble material, e.g. paper, wax paper, viscose, polyolefin film, polyester film, etc. it is preferred to form the outer film from non-woven fabric. Non-woven polyester fabrics of density ranging from about 10 to 40 grams per square meter, preferably 15 to 30 grams per square meter, especially 18 to 24 grams per square meter have proven effective in practice. It has also been found convenient for most product formulations to use from about 50 to 150 grams of the thickened suspension, preferably 60 to 120 grams, such as 80, 90, 100 or 110 grams, per wash, this amount conveniently fitting in a single sachet dispenser, measuring, for example, from about 3 to 4 or more inches per side, such as 3.5 in.×3.5 in. or 3.75 in.×3.75 in. or 4 in.×4 in.

In place of polyvinyl alcohol film or sheet as the water soluble material for forming the water soluble inner bag of the double wall sachet, other water soluble films or sheets can be used. For example, mention may be made of polyethylene oxide, methyl cellulose, gelatine, polysaccharides, and the like.

The use of a double wall sachet wherein the outer wall is formed of a sealed water insoluble permeable material is two-fold. The water insoluble outer bag can protect the water soluble inner bag from exposure to moisture, e.g. humidity, during storage, but being water permeable will allow exposure of the water soluble film and liquid detergent product so that the detergent and fabric treating ingredients can be dispersed to the fabrics during the wash cycle. Furthermore, because the outer bag of the sachet is and remains sealed during the washing, rinsing, and spin-dry operations of the washing machine, any residue of the water soluble inner bag will be retained within the sachet and will not be deposited on the fabric being laundered. For instance, portions of the partially hydrolyzed polyvinyl acetate may be water insoluble and form clumps upon dissolution of the water soluble portions. These clumps will be retained within the water insoluble outer bag. Also, it may in some case be advantageous to render the inner bag partially water insoluble, for example, by a wax coating, to enhance storage stability. This wax coating will also be retained within the permeable but insoluble outer bag of the sachet.

It is understood that the foregoing detailed description is given merely by way of illustration and that variations may be made therein without departing from the spirit of the invention.

It should also be understood that as used in the specification and in the appended claims the term "non-aqueous" means absense of water, however, small amounts of water, for example up to about 5%, preferably up to about 2%, may be tolerated in the compositions, and therefore, "non-aqueous" compositions can include such small amounts of water, whether added directly or as a carrier or solvent for one of the other ingredients in the composition.

The invention will now be described by way of the following non-limiting example in which all proportions and percentages are by weight, unless otherwise indicated. Also, atmospheric pressure is used unless otherwise indicated.

EXAMPLE 1

A non-aqueous built liquid detergent composition according to the invention is prepared by mixing and finely grinding to about 4 microns the following ingredients in the following approximate amounts (ground base A) and thereafter adding to the resulting dispersion, with stirring, the components B:

| | Amount Weight % (Based on A + B) |
|---|---|
| Ground Base A | |
| Nonionic Surfactant [1] | 32% |
| Diethylene glycol monobutyl ether | 10.5% |
| Sodium tripolyphosphate (hydrated) | 30% |
| Sokolan HC 9786 [2] | 2% |
| Carboxymethyl cellulose | 1% |
| Sodium perborate monohydrate | 11% |
| Tetraacetylethylenediamine | 4.5% |
| DEQUEST 2066 [3] | 1% |
| Tinopal ATS-X (optical brightener) | 0.3% |
| $TiO_2$ (Rutile) | 0.4% |
| Bentone 27 [4] | 0.45% |
| Post Addition B | |
| Eazyme slurries [5] | 0.55% |
| Nonionic surfactant [1] | 3% |

[1] Purchased from BASF, a mixed propylene oxide (4 moles) - ethylene oxide (7 moles) condensate of a fatty alcohol having from 13 to 15 carbon atoms
[2] Copolymer of methacrylic acid and maleic anhydride
[3] Diethylene triamine pentamethylene phosphonic acid
[4] Hectorite clay, modified with dimethyl benzyl hydrogenated tallow ammonium chloride, 35% cation exchanged, from NL Industries
[5] Mixture of Alcalase 2.5 L (0.25%), Savinase 8SL (0.2%), Termamyl 300 SL (0.1%) enzyme slurries (in nonionic surfactant) (products of NOVO)

The composition, after standing for one day, had yield stress of 20 Pa and a plastic viscosity of 160 m Pa·sec. The above composition and a comparison composition without the organophilic clay stabilizer are each filled into three 1 liter glass containers and allowed to stand for 3 months at 4° C., room temperature (approximately 22° C.), and 35° C. and the amount of free liquid on the top of each sample is measured. The results are shown in the following table.

PHYSICAL STABILITY AFTER 3 MONTHS

| | Liquid Separation (millimeters) Temperature | | |
|---|---|---|---|
| | 4° C. | 22° C. | 35° C. |
| Example (with Bentone) | 1 (1) | 1 (1) | 1 (1) |
| Comparison (without Bentone) | 9 (3) | 14 (5) | 18 (8) |

In the above table, the numbers in parentheses represent the results when the above test is repeated except that the bottles are vigorously shaken by hand for about 15 seconds once every two weeks.

Thus, it can be seen that the addition of small amounts of organophilic clay substantially improve the physical stability of the non-aqueous suspensions. Although not wishing to be bound by any theory, it appears that the organophilic clay adds sufficient body to the composition, forming a structure analogous to an elastic network of particles, which can maintain the physical stability and configuration of the formulation even when it is subjected to sufficient shaking or shearing to result in breakage of the flocculated network of the suspended builder and other fabric treating particles.

If the above example is repeated except that in place of Bentone 27, Bentone 38 (hectorite clay modified with dimethyldioctadecyl ammonium chloride) is used, similar results will be obtained. Similarly, replacing the Plurafac LF400 with Plurafac RA20, Plurafac D25, Plurafac RA50, or Dobanol 25-7 or Neodol 23-6.5, will provide similar results.

EXAMPLE 2

This example relates to a double wall sachet package according to this invention. Two polyvinyl alcohol films measuring approximately 3.35 inches wide by 3.75 inches long are heat sealed to each other along both longitudinal edges and along a line spaced about 0.2 inches from the bottom edge. The polyvinyl alcohol films used were obtained from Nedi Co. of France, under the tradename NEDOL 210EF (about 85% hydrolyzed polyvinyl alcohol). The PVA pouch is then filled with about 100 grams of the composition described in Example 1 through the opening in the top portion of the pouch. Thereafter the top portion is also heat sealed along a line spaced about 0.2 inches from the top edge. The heat sealing is carried out at a sealing pressure of about 2.0 $Kg/cm^2$ for about 1 second using sealing bars heated to a temperature in the range of about 35° C. to 70° C., depending on the relative humidity. For instance, at a relative humidity of 40%, a sealing temperature of from about 55–60° C. is satisfactory, while at 70% R.H. a temperature of from 43–49° C. is recommended; and at 80% R.H. a temperature of from 38° C. to 43° C. is recommended.

The outer pouch is formed from a non-woven polyester containing about 40% of binder fiber, having a fabric density of 24 grams per square meter and available from Kendall Co. of Boston, Mass. Two sheets of the non-woven fabric each measuring about 3.75 inches wide by about 4 inches long are placed on either side of the polyvinyl alcohol inner bag such that the side edges of the polyester fabric are equally spaced from the side edges of the inner bag while the bottom and top edges of the inner and outer bags are aligned. The polyester fabric sheets are then heat sealed along the four outer edges thereof to form the outer bag. Furthermore, the outer bag is heat sealed to the inner bag along lines approximately 0.1 inch from the top and bottom edges of the pouch.

The double wall sachet can be stored for extended periods without degradation of the inner bag or the thickened non-aqueous liquid detergent. The sachet can be placed in a conventional laundry automatic washing machine and all of the liquid detergent will be dispensed during the wash cycle. Clumps of undissolved residual polyvinyl alcohol remaining from the inner bag remain within the sachet at the conclusion the wash cycle—including the rinse and spin dry cycles.

What is claimed is:

1. A non-aqueous liquid fabric treating composition which comprises a non-aqueous liquid comprising a nonionic surfactant, fabric-treating solid particles selected from the group consisting of detergent builders, bleaching agents, antistatic agents, and mixtures thereof suspended in said non-aqueous liquid, and an organophilic clay, in an amount from about 0.2% to about 1% by weight, based on the weight of the composition, as a stabilizing agent to inhibit settling of the suspended particles, said organophilic clay comprising a swelling smectite clay modified with a nitrogen containing compound including at least one long chain hydrocarbon having from about 8 to about 22 carbon atoms.

2. The fabric treating composition of claim 1 wherein the suspended particles have an average particle size of 15 microns or less, no more than about 10% by weight of said particles having a particle size of more than about 15 microns.

3. The fabric treating composition of claim 1 wherein the suspended particles have an average particle size of from about 1 to 10 microns, no more than about 10% by weight of said particles having a particle size of more than about 10 microns.

4. The fabric treating composition of claim 3 wherein said nitrogen containing compound is a quaternary ammonium compound.

5. The fabric treating compound of claim 4 wherein the quaternary ammonium compound is a compound of the formula $$[R_1R_2R_3R_4N]^+X^-$$

wherein $R_1$, $R_2$, $R_3$ and $R_4$ are each, independently, hydrogen or an alkyl, alkenyl, aryl, aralkyl or alkaryl group having from 1 to 22 carbon atoms, at least two of $R_1$–$R_4$ having from 1 to about 6 carbon atoms and at most two of $R_1$–$R_4$ having from about 8 to about 22 carbon atoms; and X is an inorganic or organic anion.

6. The fabric treating composition of claim 1 wherein the nonionic surfactant is an alkoxylated fatty alcohol having from about 10 to about 22 carbon atoms.

7. The fabric treating composition of claim 6 wherein the fatty alcohol is a $C_{12}$ to $C_{18}$ alcohol alkoxylated with up to about 12 moles ethylene oxide and up to about 8 moles propylene oxide.

8. The fabric treating composition of claim 7 wherein the non-aqueous liquid further comprises a diluent or organic solvent selected from the group consisting of lower alcohols having from 1 to about 6 carbon atoms, and alkylene glycols having from 2 to about 6 carbon atoms.

9. The fabric treating composition of claim 7 wherein the non-aqueous liquid further comprises a viscosity-controlling and antigelling amount of an alkylene glycol ether of the formula $$RO(CH_2CH_2O)_nH$$

wherein R is a $C_2$ to $C_8$ alkyl group and n is a number having an average value of from about 1 to 6.

10. The fabric treating composition of claim 9 wherein the alkylene glycol ether is diethylene glycol monobutyl ether.

11. The fabric treating composition of claim 1 wherein the non-aqueous liquid comprises from about 30% to about 70% by weight of the composition and the suspended solid particles comprise from about 70% to about 30% by weight of the composition.

12. The fabric treating composition of claim 11 wherein the non-aqueous liquid comprises from about 45% to 55% by weight of the composition and the suspended solid particles comprise from about 55% to 45% by weight of the composition.

13. The fabric treating composition of claim 1 comprising from about 30 to about 60% of alkoxylated fatty alcohol nonionic surfactant;

from about 0% to about 20% of alkylene glycol ether viscosity control and antigelling agent;

from about 20% to about 50% of detergent builder particles; and from about 0% to about 50% in total of one or more optional detergent additives selected from the following: enzymes, enzyme inhibitors, corrosion inhibitors, anti-foam agents, suds suppressors, soil suspending agents, anti-yellowing agents, colorants, perfumes, optical brighteners, bluing agents, pH modifiers, pH buffers, bleaching agents, bleach stabilizers, and sequestering agents.

14. The fabric treating composition of claim 1 wherein the amount of the organophilic clay is from 0.2% to 0.7% by weight of the composition.

15. A heavy duty built liquid thickened non-aqueous laundry detergent composition comprising from about 30% to about 40% of a liquid nonionic surfactant which is a mixed ethylene oxide—propylene oxide condensate of a fatty alcohol having from about 12 to about 18 carbon atoms;

from about 25% to about 40% of alkali metal phosphate detergent builder salt;

from about 5% to about 12% of an alkylene glycol ether solvent as a viscosity control and anti-gelling agent;

from about 0.2% to about 0.7% of an organophilic modified smectite clay in which from about 10% to 100% of the available base exchange capacity of the smectite clay is replaced by an organic cationic nitrogen compound having at least one long chain hydrocarbon with from about 8 to about 22 carbon atoms;

from about 2% to about 20% of a peroxide bleaching agent;

from about 0.1% to about 8% of a bleach activator;

up to about 2% of enzymes;

up to about 10% of soil suspending, anti-redeposition and anti-yellowing agents;

up to about 5% of high complexing power sequestering agent; and up to about 2% each of one or more of colorants, perfumes and optical brighteners;

the solid components of said composition being stably suspended in the liquid components of said composition and having an average particle size in the range of from about 2 to 10 microns, with no more than about 10% of the particles having a particle size of more than 10 microns; said composition having a plastic viscosity in the range of from about 0.05 Pa·sec to 0.5 Pa·sec.

* * * * *